US006050284A

United States Patent [19]

Caine et al.

[11] Patent Number: 6,050,284

[45] Date of Patent: Apr. 18, 2000

[54] RV GENERATOR AUXILIARY EXHAUST SYSTEM METHOD

[75] Inventors: Donald R. Caine, Greensboro; Mark R. Bailey, Madison, both of N.C.

[73] Assignee: CAMCO Manufacturing, Inc., Greensboro, N.C.

[21] Appl. No.: 09/177,983

[22] Filed: Oct. 22, 1998

Related U.S. Application Data

[62] Division of application No. 08/937,689, Sep. 29, 1997, Pat. No. 5,839,473, which is a continuation of application No. 08/666,196, Jun. 20, 1996, abandoned.

[51] Int. Cl.[7] ..... F16L 55/18; E03B 5/00; F16K 5/00

[52] U.S. Cl. ..... 137/15; 137/888; 137/527.6; 138/44; 181/263

[58] Field of Search ..... 137/888, 527.6, 137/15; 181/277, 228, 262, 263; 138/44, 45; 285/9.2

[56] References Cited

U.S. PATENT DOCUMENTS

| | | | |
|---|---|---|---|
| 1,856,005 | 4/1932 | Tomshow | 181/263 |
| 1,867,802 | 7/1932 | Bogert | 181/263 |
| 2,694,358 | 8/1954 | Taylor | 98/59 |
| 3,404,445 | 10/1968 | Crouse | 29/157 |
| 3,655,010 | 4/1972 | DuBois | 181/36 B |
| 3,695,192 | 10/1972 | Von Brimer | 110/8 A |
| 3,746,126 | 7/1973 | De Cardenas | 181/67 |
| 3,827,523 | 8/1974 | Williams | 180/68 R |
| 3,941,041 | 3/1976 | Sprout | 137/580 |
| 4,029,167 | 6/1977 | Fox et al. | 180/64 A |
| 4,072,329 | 2/1978 | Mutchler | 285/9 |
| 4,143,731 | 3/1979 | Haustein | 180/64 A |
| 4,202,371 | 5/1980 | Armstrong | 137/604 |
| 4,614,086 | 9/1986 | Koch | 60/624 |
| 4,871,922 | 10/1989 | Heinrich et al. | 180/68.1 |
| 5,328,209 | 7/1994 | Cromwell | 285/1 |
| 5,362,273 | 11/1994 | Pfeiffer, Jr. et al. | 454/63 |
| 5,466,900 | 11/1995 | Knapp | 181/227 |

*Primary Examiner*—Henry Bennett
*Assistant Examiner*—Joanne Y. Kim

[57] ABSTRACT

An auxiliary exhaust system is provided for releasable attachment to internal combustion engines as are used on electrical generators of recreational vehicles or the like. The auxiliary exhaust system is easy to assemble and disassemble and directs combustion gases which have been cooled by ambient air upwardly to protect the RV occupants and near passersby. The auxiliary exhaust system provides a venturi effect with plastic stack sections which are slidably joined and which are light in weight. Shock cords stabilize the assembled auxiliary exhaust system and prevent noise transmittal from the generator and during adverse weather conditions such as high winds.

8 Claims, 2 Drawing Sheets

RV GENERATOR AUXILIARY EXHAUST SYSTEM METHOD

This is a division of application Ser. No. 08/937,689, filed Sep. 29, 1997, now U.S. Pat. No. 5,839,473, which is a continuation of application Ser. No. 08/666,196 filed Jun. 20, 1996, now abandoned.

BACKGROUND OF THE INVENTION

1. Field of the Invention

The invention herein pertains to exhaust systems for internal combustion engines, and in particular to auxiliary exhaust systems for generator motors as are used on recreational vehicles.

2. Background and Objectives of the Invention

In recent years there has been an increase in the number of recreational vehicles sold and used in this country such as motor homes, campers and the like, since more families travel about on vacations, weekend leisure travel and pursuing various interests. Parks and campgrounds are becoming increasingly more crowded resulting in smaller, narrower parking spaces for motor homes and the like. Electrical generators which are often used by the motor home owners usually include an internal combustion (gasoline, diesel, propane, etc.) engine contained beneath the motor home with an exhaust system near ground level. Once the motor homes and other recreational vehicles are parked, the generators supply electricity for the occupants and the exhaust fumes created by the generator motors, which discharge the exhaust beneath the RV, can be a nuisance and can create health hazards to the occupants of nearby recreational vehicles and to others nearby since the conventional RV exhaust system emits noxious gases near ground level. Certain conventional RV auxiliary exhaust systems in the past have been formed of metal and can easily burn a child or adult who inadvertently touches the exhaust stack during operation. Such prior metal exhaust systems are expensive, heavy and difficult to attach, remove and store during transportation. Flexible plastic hoses used in the past as part of auxiliary exhaust systems can also become very hot to the touch.

Thus, with the problems and disadvantages of prior RV auxiliary and standard exhaust systems, it is one objective of the present invention to provide an improved auxiliary RV exhaust system which can be easily assembled, attached, stabilized, disassembled and stored by a single, relatively unskilled person in a short period of time.

It is another objective of the present invention to provide an RV auxiliary exhaust system and method which allows adjustability in its vertical positioning as needed by adding or removing exhaust stack sections.

It is a further objective of the present invention to provide an auxiliary exhaust system having an outer surface which remains relatively cool by the use of a venturi effect.

It is a still another objective of the present invention to provide an RV auxiliary exhaust system which utilizes rigid lightweight tubular plastic stack sections for vertical height adjustments which become only slightly warm as the generator motor is operated.

It is also another objective of the present invention to provide an RV auxiliary exhaust system for attaching to a generator motor which is relatively light in weight for convenience in handling and which is inexpensive to manufacture and purchase.

Various other objectives and advantages of the present invention will become apparent to those skilled in the art as a more detailed description is set forth below.

SUMMARY OF THE INVENTION

The aforesaid and other objectives are realized by providing an auxiliary exhaust system and method for an RV generator internal combustion engine having a metal coupler tube which is generally L-shaped. The coupler tube is attached to the exhaust pipe of the RV generator motor at one end and the opposite end is positioned within a first plastic exhaust stack section for directing exhaust gases passing therethrough in a vertical direction. Additional exhaust stack sections may be added to achieve a desired height, such as above the top of the recreational vehicle. The coupler tube is rotatably affixed to the generator motor exhaust pipe to allow the exhaust stack sections to be angularly disposed vertically along the side wall of the RV whereby the exhaust stack sections can be pivoted to prevent obstruction of a window of the RV for avoidance of overhead structures, or for other purposes. Elastic shock cords attached to the first stack section help stabilize the stack section against the RV in the event of adverse weather or other external conditions and prevent vibrational noises from the generator motor being transmitted to the RV side wall.

DETAILED DESCRIPTION OF THE PREFERRED EMBODIMENTS

Figure 3:
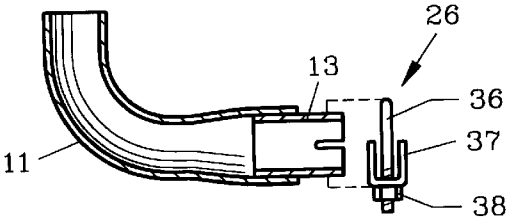
FIG. 3 is a cross-sectional view of an enlarged fragmented coupler tube.
Figure 1:
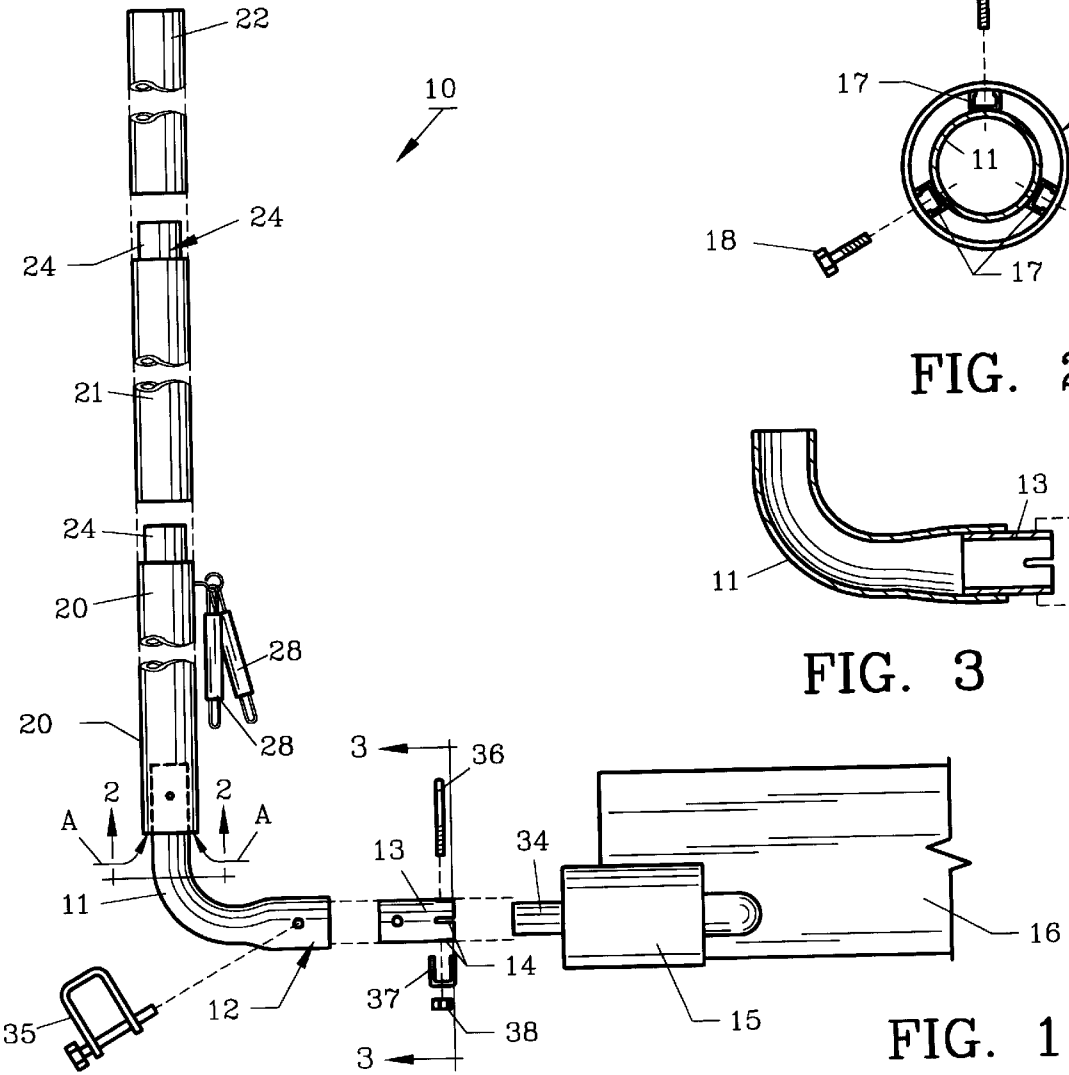
FIG. 1 illustrates an exploded view of the preferred form of the auxiliary exhaust system for an RV generator having fragmented exhaust stack sections.

For a better understanding of the invention in its preferred form, turning now to the drawings, FIG. 1 demonstrates an exploded view of the preferred RV generator auxiliary exhaust system 10 having a metal coupler tube 11 with an inside diameter of approximately 38 mm and an outside diameter of approximately 40 mm. Enlarged end 12 of coupler tube 11 has a slightly larger interior and exterior diameter to accommodate coupler adaptor 13 which is also formed from metal and which has an inside diameter of approximately 38 mm and an outside diameter of approximately 40 mm. Standard pivot clip 35 secures coupler adaptor 13 to enlarged end 12 of tubular coupler 11. Coupler adaptor 13 includes a series of open-ended slots 14 to provide a degree of flexibility, such as when attaching adaptor 13 over an old, corroded exhaust pipe such as exhaust pipe 34 which is affixed to muffler 15 of RV generator motor 16, shown in FIG. 1. Also, slots 14 allow adaptor 13 to fit a variety of exhaust pipe diameters as are used in the trade. In order to securely affix coupler adaptor 13 over exhaust pipe 34, clamp 26 is provided which includes U-shaped threaded member 36, latch plate 37 and a pair of nuts 38, (only one nut illustrated in FIG. 3). Once adaptor 13 is so attached, tubular coupler 11 can be joined thereto by pivot clip 35 or removed as needed, without removing adaptor 13 from exhaust pipe 34 each time exhaust system 10 is taken down, such as during travel to a remote RV park.

Figure 2:
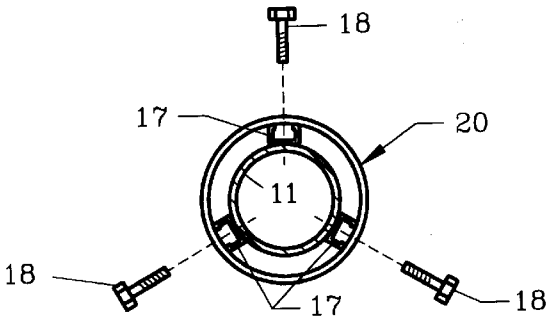
FIG. 2 is an enlarged cross-sectional view of the coupler tube as shown along lines 2—2 of FIG. 1.

Polycarbonate stack section 20 is rigid, a poor heat conductor, light in weight and has an outside diameter of approximately 78 mm and an inside diameter of approximately 76 mm. As seen in FIG. 2, tubular coupler 11 is spaced inwardly from the bottom interior walls of stack section 20 and is attached thereto by spacers 17 which may be formed of suitable plastic or metal and held in place by threaded members 18. As also seen in FIG. 1, tubular connector 11 is positioned within stack section 20 for a length of approximately 150 mm. Stack sections 20, 21 and 22 are shown in fragmented form in FIG. 1 for brevity. Due to the open spacing between stack section 20 and tubular connector 11, a "venturi" effect is provided with ambient air as shown by arrows A in FIG. 1, freely entering the bottom of stack section 20 drawn therein by the rapid flow of hot exhaust gases exiting tubular coupler 11. The ambient air mixes with the hot gases inside stack section 20 which are delivered from internal combustion engine 16, to cool said hot exhaust gases. Polycarbonate stack sections 20, 21 and 22 prevent injury to passersby which may be children or adults, that might inadvertently touch the stack sections during use, as polycarbonate is a poor conductor of heat.

Figure 4:
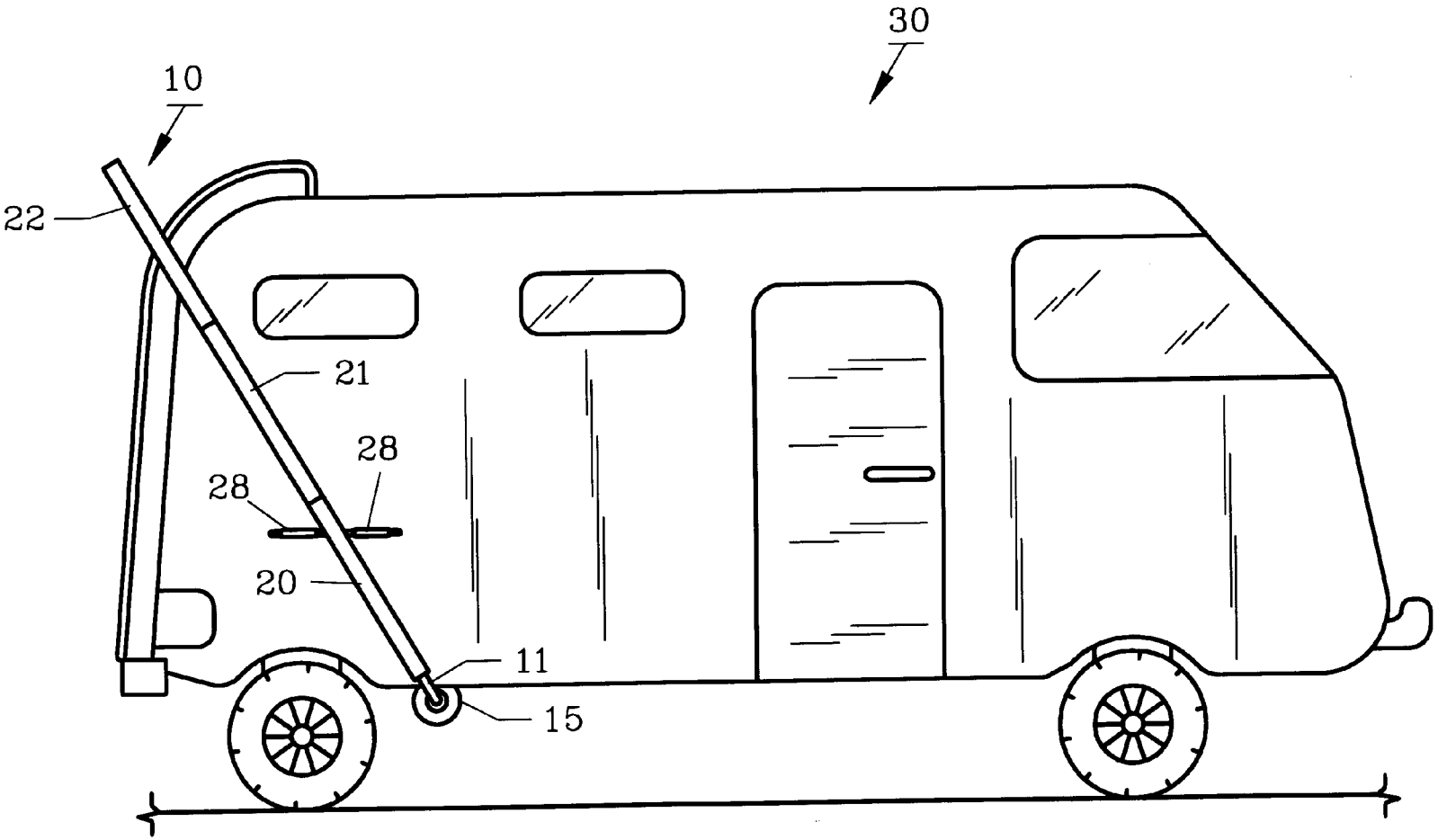
FIG. 4 is a side view of a conventional RV with the preferred auxiliary exhaust system of the invention attached.

For assembly purposes, stack sections 20 and 21 include a small diameter portion 24 for slidably joining with the lower, larger interior diameter of, for example, stack section 21 Terminal stack section 22 is similar to stack section 21, but does not have a small diameter section 24. As many stack sections 21 as needed can be added to extend RV generator auxiliary exhaust system 10 above RV 30 to a desired height to prevent nearby persons from breathing the exhaust gases. Stack sections 21, 22 are each approximately one meter in length, as is stack section 20 with small diameter portion 24 being about 100 mm in length. During high winds, storms or the like, auxiliary exhaust system 10 may be adversely impacted. To prevent damage or injury, shock cords 28 are attached to stack section 20 for affixing along the side of RV 30 as shown in FIG. 4 by screws or the like. Shock cords 28 comprise resilient rubber straps with terminal eyelets or other connectors to allow RV generator auxiliary exhaust system 10 to be adequately, resiliently stabilized and to prevent irritating vibrational noises for the RV occupants during the operation of the generator or in adverse weather conditions.

As shown in FIG. 4, RV generator exhaust system 10 utilizes stack section 21 and terminal stack section 22 in the usual, preferred configuration, although additional stack sections 21 may be employed for greater exhaust height as desired.

The preferred method of the invention is described by attaching an adaptor such as by sliding adaptor 13 onto exhaust pipe 34 as seen in FIG. 1. Adaptor 13 includes slots 14 which allow adaptor 13 to flex to accommodate exhaust pipes having different diameters. Clamp 26 is then placed over adaptor 13 and is tightened in place. Next, coupler 11, having stack section 20 affixed is joined to adaptor 13 by pivot clip 35. Additional stack sections 21, 22 are added by slidable engagement as necessary for the desired height. Additional stack sections 21 can be added for more height. Adaptor 13 can be rotated on exhaust pipe 34 to any desired position, for example, to have an exhaust system which is biasly mounted, as seen in FIG. 4. Removal of exhaust system 10 can be accomplished without removal of adaptor 13 which usually remains in place once initially installed.

The illustrations and examples provided herein are for explanatory purposes and are not intended to limit the scope of the appended claims. Changes in the shapes and materials employed herein are anticipated by those skilled in the art as different plastics, sizes and configurations may be used as available without departing from the inventive concept divulged.

We claim:

1. A method of exhausting fumes from an internal combustion type generator having a horizontal primary exhaust pipe extending from a muffler, the method comprising:

a) attaching an adaptor tube to said horizontal exhaust pipe;

b) attaching an L-shaped coupler to said adaptor tube;

c) attaching a plurality of vertical exhaust stack sections to said coupler in such a manner as to form a venturi therewith; and d) venting fumes through said adaptor tube, said coupler and said stack sections.

2. The method of claim 1 wherein attaching a plurality of vertical exhaust stack sections comprises the step of attaching a plurality of vertical low thermal conduction plastic exhaust stack sections.

3. The method of claim 1 wherein attaching an adaptor tube to said horizontal exhaust pipe comprises the step of attaching a slotted adaptor tube to said horizontal exhaust pipe.

4. The method of claim 1 wherein attaching an L-shaped coupler to said adaptor tube comprises the step of attaching an L-shaped coupler which includes one end which is larger than the other to said adaptor tube.

5. A method of exhausting fumes from an internal combustion type generator on a recreational vehicle having a horizontal primary exhaust pipe extending from a muffler, the method comprising:

a) attaching an adaptor tube to said horizontal exhaust pipe;

b) attaching an L-shaped coupler to said adaptor tube;

c) attaching a plurality of vertical exhaust stack sections to said coupler in such a manner as to form a venturi therewith; and d) venting fumes through said adaptor tube, said coupler and said stack sections.

6. The method of claim 5 wherein attaching a plurality of vertical exhaust stack sections comprises the step of attaching a plurality of vertical low thermal conduction plastic exhaust stack sections.

7. The method of claim 5 wherein attaching an adaptor tube to said horizontal exhaust pipe comprises the step of attaching a slotted adaptor tube to said horizontal exhaust pipe.

8. The method of claim 5 wherein attaching an L-shaped coupler to said adaptor tube comprises the step of attaching an L-shaped coupler which includes one end which is larger than the other to said adaptor tube.

* * * * *